US005384519A

United States Patent [19]

Gotoh

[11] Patent Number: 5,384,519

[45] Date of Patent: Jan. 24, 1995

[54] COLOR MIXING METHOD FOR VARIABLE COLOR LIGHTING AND VARIABLE COLOR LUMINAIRE FOR USE WITH THE METHOD

[75] Inventor: Shigeo Gotoh, Yao, Japan

[73] Assignee: Matsushita Electric Works, Ltd., Japan

[21] Appl. No.: 160,377

[22] Filed: Dec. 1, 1993

[30] Foreign Application Priority Data

Dec. 9, 1992 [JP] Japan ..... 4-329685

[51] Int. Cl.[6] ..... H05B 37/00

[52] U.S. Cl. ..... 315/324; 315/151; 315/158; 362/231

[58] Field of Search ..... 315/324, 151, 154, 158; 362/231; 348/271, 760, 799; 358/509, 518

[56] References Cited

U.S. PATENT DOCUMENTS 4,273,999 6/1981 Pierpoint ..... 315/158 X
5,031,078 7/1991 Bornhorst ..... 362/231 X

FOREIGN PATENT DOCUMENTS 93201675.1 11/1993 European Pat. Off. .

OTHER PUBLICATIONS

Patent application Ser. No. 08/111,236, Takeuchi, Aug. 24, 1993.

*Primary Examiner*—Robert J. Pascal
*Assistant Examiner*—Haissa Philogene
*Attorney, Agent, or Firm*—Kenyon & Kenyon

[57] ABSTRACT

A variable color lighting arrangement includes at least first to third light sources and at least another light source, and allows a desired mixed color light to be obtained in a relatively simpler manner, such that an emission color of a temporary light source is first imaginarily set with an emission color of one of the first to third light sources mixed with another emission color of the said another light source, a mixing ratio is calculated with emission colors of remaining two or more of the plurality of light sources including at least the first to third light sources and the emission color of the temporary source, and a required mixing ratio of the respective light sources for obtaining the desired mixed color light is obtained on the basis of the calculated mixing ratio.

14 Claims, 7 Drawing Sheets

COLOR MIXING METHOD FOR VARIABLE COLOR LIGHTING AND VARIABLE COLOR LUMINAIRE FOR USE WITH THE METHOD

BACKGROUND OF THE INVENTION

This invention relates to a color mixing method for a variable color lighting, capable of obtaining a mixed color light of any desired emission color with a plurality of light sources of different emission colors employed and with a dimming level adjusted with respect to the respective light sources, and a variable color luminaire for use with the color mixing method.

DESCRIPTION OF RELATED ART

In recent years, it has been a growing demand that ambient atmosphere can be varied as desired by means of illumination light, and there have been suggested various lighting systems of variable color to comply with such demand. In this event, an arrangement is so made that emissions of light sources of different emission colors are mixed to obtain the mixed color light of a desired emission color. Assuming here that the light sources respectively of three different colors such as red (R), green (G) and blue (B) series, that the emission colors of the respective light sources are of such chromaticity coordinates as $(x_R,y_R)$, $(x_G,y_G)$ and $(x_B,y_B)$, and that the respective light sources are of such quantity of emitted light as $Y_R$, $Y_G$ and $Y_B$, then there is satisfied such relationship between the illumination light of a mixed color and its quantity of light $Y_o$ as $$Y_o = Y_R + Y_G + Y_B$$

The desired emission color is to be obtained, therefore, by executing an adjustment of mixing ratio through an optimum control means with respect to the illumination light from the light sources of three different colors. The control means employable here will be one which can individually light the respective light sources and perform a dimming of the respective light sources through a phase control of powers supplied from an AC power source to the respective light sources, and the light mixing ratio of the light sources can be readily determined so long as the emission colors of the respective light sources and the desired emission color of the mixed color light are set definitely.

A variable color lighting system of the foregoing arrangement generally comprises means including a setting switch and an up/down counter for setting the mixing ratio of emissions from the respective light sources, a memory means capable of executing a proper address setting and storing data representing dimming level of the respective light sources for obtaining the desired emission color of the mixed color light for every address, desirably in a set for three of the data, and means receiving the address data from the memory means for generating dimming signals. With this lighting system, and addressing is made from the mixing ratio setting means to the memory means, the address data are provided from the memory means to the dimming signal generating means, the dimming signals are provided from the generating means to an optimum lighting circuit in accordance with the address data to have the respective light sources lighted, and the desired mixed color light is obtained.

In the case where the light sources are of three colors as in the above, however, there has been a problem that the quantity of light cannot be made sufficient, and the dimming control over a wide range cannot be attained. In view of this, there has been suggested an arrangement for achieving the wide range dimming control with respect to the light sources of four colors with a further light source of white series (W) added to attain the desired mixed color light.

As shown in FIG. 10, when the emission colors of the repective light sources of the four colors in the variable color lighting system are presented on the chromaticity diagram, the chromaticity coordinates of the white light source emission are positioned within a triangle formed by connecting respective chromaticity coordinates of red, green and blue and, as will be readily appreciated, the mixed color having the chromaticity coordinates disposed within such triangle and with the quantity of light made dimmable over a wide range can be obtained. More specifically, it should be assumed that the mixed color light of an emission color X the chromaticity coordinates of which are positioned within the foregoing triangle is to be obtained. Then, a line component connecting between the chromaticity coordinates W of the white series light and the chromaticity coordinates X of the above mixed color light is imagined, and a point $\beta$ corresponding to the desired mixed color is obtained on a line component $W\alpha$ extending from the chromaticity coordinates W to an intersecting point $\alpha$ of the line component between both coordinates W and X with a line component connecting between both chromaticity coordinates B and R, that is, the base of the foregoing triangle. Then, a mixing ratio is obtained for obtaining the chromaticity coordinates of the desired mixed color light from the point $\beta$ and the chromaticity coordinates W of the white series color, and thereafter the maximum luminous flux obtainable with this mixing ratio is obtained. Since then, the operation for obtaining the mixing ratio and maximum luminous flux is repeated with respect to other points on the foregoing line component $W\alpha$, and obtained values are employed as the optimum values for obtaining the desired mixing ratio of the maximum luminous flux on the line component $W\alpha$. Generally, importance is attached to the value of the luminous flux rather than any slight deviation in the emission color of the mixed color light, and the color mixing ratio can be determined in a sequential manner.

In the foregoing variable color lighting system, the dimming level is set for the respective light sources in accordance with the desired color mixing ratio, and this color mixing ratio is stored in the memory means as part of the data so as to utilized later on when the dimming level is to be determined again. Further, when the emission color of the mixed color light is varied sequentially, the chromaticity coordinates of the desired mixed color light move inside the triangle formed by connecting the chromaticity coordinates of red, green and blue, and a desired locus can be drawn by this movement.

However, in an event where the emission color is varied to be x, x1, x2, . . . inside the foregoing triangle of the chromaticity diagram, for example, the chromaticity coordinates are to move within the triangle to be line components Wα, Wα1, Wα2, . . . extending from the chromaticity coordinates W until they intersect the base of the triangle. In this event, there arises a problem that, in addition to the necessity of obtaining the color mixing ratio of the three colors of red R, green G and blue B so as to obtain one point on the line component Wα for every movement of the line component, the chromaticity coordinates x of the desired mixed color light must be obtained by means of the point β obtained on the line component Wα when the three colors of red R, green G and blue B as well as the chromaticity coordinates W of the white series color are mixed, and the system is rendered to be complicated in the operation step or means.

For the prior art relative to the foregoing variable color lighting system referred to in the above, there may be enumerated U.S. patent applications Ser. Nos. 073,373 and 111,236 (corresponding to EP applications Nos. 93 201675.1 and 93 202511.7).

SUMMARY OF THE INVENTION

A primary object of the present invention is to eliminate the foregoing problems and to provide a variable color lighting arrangement which is capable of satisfactorily achieving the intended object with a simpler arrangement.

According to the present invention, the above object can be realized by means of a color mixing method for variable color lighting in which at least first to third light sources of mutually different emission colors are prepared, and the emission colors of these light sources are mixed with a further emission color of at least another light source, said further emission color being of chromaticity coordinates disposed within a figure drawn on chromaticity diagram by connecting respective chromaticity coordinates of the emission colors of the first to third light sources, to thereby obtain a mixed color light which draws a desired locus on the chromaticity diagram, characterized in that an emission color of a temporary light source is imaginarily set by mixing the emission colors of one of the plurality of the light sources including the first to third light sources and of at least another light source, a mixing ratio is calculated with the emission colors of remaining two or more of the light sources in the plurality of the light sources including at least the first to third light sources, and a further mixing ratio is obtained for the respective light sources required for obtaining a desired mixed color light on the basis of the calculated mixing ratio.

Other objects and advantages of the present invention shall become clear as following description of the invention detailed with reference to accompanying drawings advances.

While the present invention shall now be described with reference to the respective embodiments shown in the accompanying drawings, it should be appreciated that the intention is not to limit the invention only to the embodiments shown but rather to include all alterations, modifications and equivalent arrangements possible within the scope of appended claims.

DETAILED DESCRIPTION OF THE PREFERRED EMBODIMENTS

Figure 1:
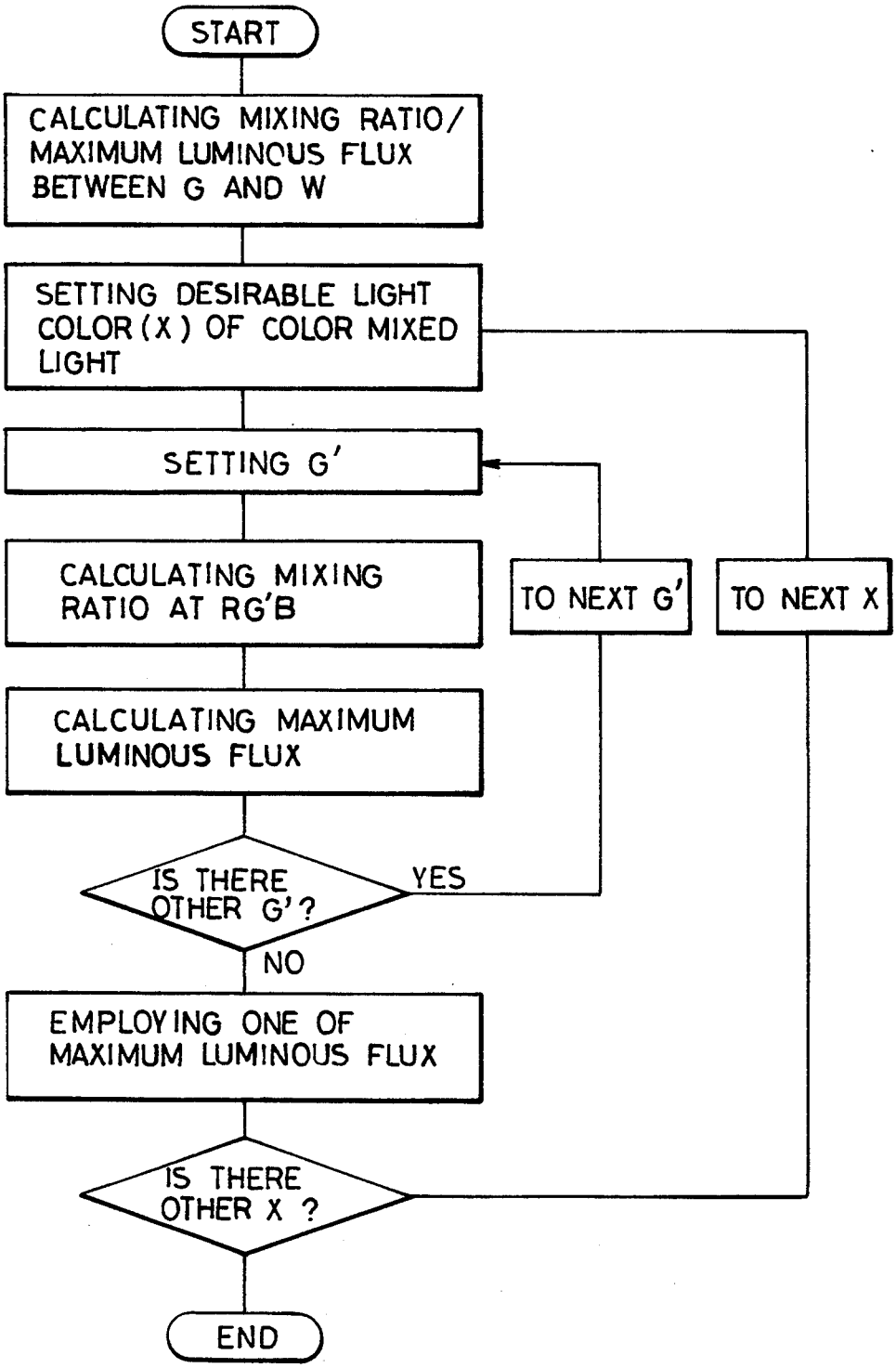
FIG. 1 shows in a flow chart an embodiment of the color mixing method for variable color lighting according to the present invention.

In the color mixing method for the variable color lighting according to the present invention, the color mixing is executed in such sequence as shown in the flow chart of FIG. 1. In this case, there are employed first to third light sources preferably of red (R), green (G) and blue (B) series for the color mixing. Here, a triangle is drawn on the chromaticity diagram by connecting three chromaticity coordinates of the emission colors of these light sources. Another light source which is, in the present embodiment, fourth light source the chromaticity coordinates of which are positioned inside the above triangle is employed. For this fourth light source, it is optimum to use a light source of white (W) series. See FIG. 2 in these respects.

In the present embodiment, an emission color of any one of the first to third light sources of red (R), green (G) and blue (B) series is mixed with another emission color of another light source to imaginarily set a temporary light source, a mixing ratio is calculated with remaining two light sources among the light sources of red (R), green (G) and blue (B) series and with the temporary light source, and a further mixing ratio with respect to the respective light sources required for a desired mixed color light is obtained from a result of the calculation.

Figure 2:
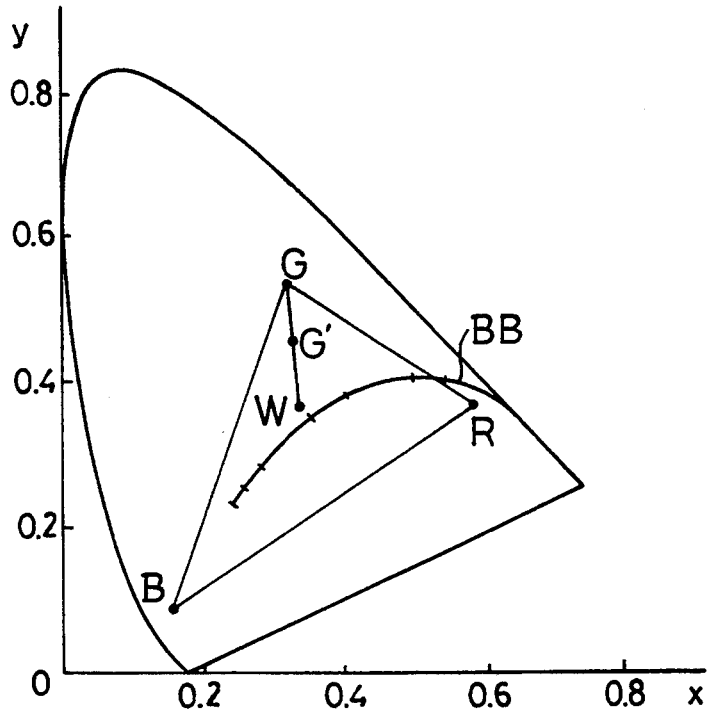
FIG. 2 is a chromaticity diagram for explaining an operation for obtaining the color mixing ratio in the embodiment shown in FIG. 1.

Referring also to FIG. 2, functions G(G'), W(G') and $\phi$(G') of the color mixing ratio and maximum luminous flux at the time when a point G' representing the temporary light source is moved on a line component connecting between the chromaticity coordinates G and W of the emission colors of corresponding light sources on the chromaticity diagram in FIG. 2. Provided that the emission colors of the light sources G and W are represented by such chromaticity coordinates as $(x_W, y_W)$ and $(x_G, y_G)$, that the luminous fluxes of the respective light sources are $Y_W$ and $Y_G$ and that the chromaticity coordinates of the temporary light source G' are $(x_{G'}, y_{G'})$ while the luminous flux thereof is $Y_{G'}$, then:

$$x_{G'}=\{(x_W/y_W)\cdot Y_W+(x_G/y_G)\cdot Y_G\}/\{(Y_W/y_W)+(Y_G/y_G)\}$$

$$Y_{G'}=(Y_W+Y_G)/\{(Y_W/y_W)+(Y_G/y_G)\}$$

$$Y_{G'}=Y_W+Y_G$$

and it is possible to vary the chromaticity coordinates $x_{G'}$ and $y_{G'}$ by varying $Y_W$:$Y_G$.

Next, an emission color X of a desired mixed color light is set, and a desired point G' on the line component GW. In obtaining the mixed color light of this kind, it often happens that the luminous flux constitutes an important element therefor as described in the above, and it is preferable in general to determine the maximum flux in a manner as will be described in the followings, and to employ as the temporary light source the light source or sources having the chromaticity coordinates G' at which the maximum luminous flux can be obtained.

Now, provided that $Y_W$:$Y_G$=the maximum luminous flux of W:A in which A does not exceed the maximum luminous flux of G, max. lum. flux of W+max. lum. flux of G×($Y_G/Y_W$) will be the maximum luminous flux of G'. When A exceeds the maximum luminous flux of G, on the other hand, max. lum. flux of W×($Y_W-Y_G$)+max. lum. flux of G will be the maximum luminous flux of G', and the light source the chromaticity coordinates of which are G' at which this maximum luminous flux can be obtained is employed as the temporary light source.

With the thus obtained G' employed, the mixing ratio with respect to the respective light sources R, G' and B is calculated. Provided here that the emission colors of these light sources R, G' and B are represented by such chromaticity coordinates as $(x_R, y_R)$, $(x_{G'}, y_{G'})$ and $(x_B, y_B)$ and that their luminous fluxes are $Y_R$, $Y_G$ and $Y_B$, then the emission color $(x_o, y_o)$ and the luminous flux of the mixed color light will be represented by the following equations:

$$x_o=\{(x_R/y_R)\cdot Y_R+(x_{G'}/y_{G'})\cdot Y_{G'}+(x_B/y_B)\cdot Y_B\}/(Y_W/y_W+Y_{G'}/y_{G'}+Y_B/y_B)$$

$$y_o=(Y_R+Y_{G'}+Y_B)/(Y_R/y_R+Y_{G'}/y_{G'}+Y_B/y_B)$$

$$Y_o=Y_R+Y_{G'}+Y_B$$

Through the above operation, the mixing ratio is obtained to be $Y_R$:$Y_{G'}$:$Y_B$.

Using the mixing ratio in the case when the maximum luminous flux is obtained, a processing is to be carried out in the manner as follows. That is, the maximum luminous flux at the particular mixing ratio is regarded to have been attained in an event where any one of the first to third light sources lighted in the mixing ratio is made to be of the maximum luminous flux but remaining two other light sources do not exceed the maximum luminous flux. Provided that, for example, $Y_R$:$Y_{G'}$:$Y_B$=max. lum. flux of R:

($Y_{G'}/Y_R$)·max. lum. flux of R:

($Y_B/Y_R$)·max. lum. flux of R and, so long as ($Y_{G'}/Y_R$)·max. lum. flux of R≦max. lum. flux of G', ($Y_{B'}/Y_R$)·max. lum. flux of R≦max. lum. flux of B then the maximum luminous flux at the desired emission color X will be max. lum. flux of R+($Y_{G'}/Y_R$)·max. lum. flux of R+($Y_B/Y_R$)·max. lum. flux of R Assuming, on the other hand, that ($Y_{G'}/Y_R$)·maximum luminous flux of R or ($Y_B/Y_R$)·maximum luminous flux of R exceeds both of the maximum luminous flux of G' and the maximum luminous flux of B, the luminous flux of $Y_{G'}$ or $Y_B$ is made the maximum and the maximum luminous flux is obtained through the same steps. The same operation as above is carried out with respect to G' at other points on the line component GW to calculate the mixing ratios and maximum luminous fluxes, and one of thus obtained mixing ratio at which the luminous flux becomes the maximum is to be employed. Further, the operation is properly repeated with respect to the desired luminous flux.

The foregoing color mixing method for the variable color lighting is useful particularly when the emission color is varied along such black-body locus as shown in the chromaticity diagram of FIG. 2. That is, in an event where the mixing ratio and maximum luminous flux of the line component GW are initially calculated and stored as a table, it is made unnecessary to carry out again the operation for obtaining the mixing ratio and maximum luminous flux in respect of the points G' on the line component GW even when the emission color of the desired mixed color light is varied. Accordingly, it should be appreciated that required number of the operation for executing the color mixing can be remarkably reduced.

Referring next to a more practical working aspect, the light sources employed here are such four colored lamps or discharge lamps including first to third lamps or discharge lamps and another fourth white series lamp or discharge lamp the emission color of which is to be mixed with that of one of the first to third lamps or discharge lamp. In this case, the first to third lamps or discharge lamps are, so to say, for use as a primary color mixing while the fourth lamp or the like is for use as a secondary color mixing.

Figure 3:
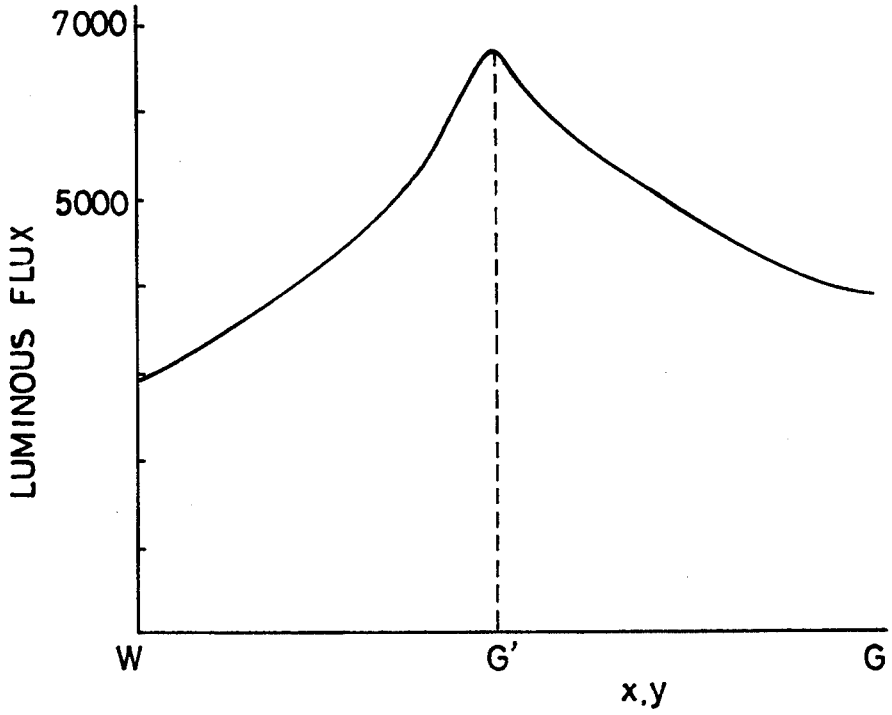
FIG. 3 is an explanatory diagram showing a relationship of the color mixing ratio on a line component WG shown in the chromaticity diagram of FIG. 2 to the luminous flux.

Here, when the chromaticity coordinates and luminous flux of the respective emission colors of these lamps are of such values as shown in a following TABLE I, their variation will be as shown in FIG. 3:

TABLE I

| Light Source | Chromaticity x | Coordinates y | Luminous Flux (1 m) |
|---|---|---|---|
| R | 0.58 | 0.33 | 2,100 |
| G | 0.329 | 0.53 | 3,800 |
| B | 0.156 | 0.083 | 840 |
| W | 0.373 | 0.376 | 2,900 |

In obtaining the desired mixed color light, the mixing ratio of the four lamps R, G, B and W is obtained from the calculation results of the mixing ratio of G', R and B with G' in FIG. 3 employed, the ratio will be as shown in a following TABLE II, with which mixing ratio the maximum luminous flux can be obtained.

TABLE II

| Color Temperature (K) | R | G | B | W |
|---|---|---|---|---|
| 3,000 | 100 | 71 | 3 | 39 |
| 5,000 | 51 | 100 | 45 | 93 |
| 10,000 | 22 | 85 | 100 | 79 |

In the above TABLE II, the values of R, G, B and W are given in % required for achieving the color temperatures of 3,000K, 5,000K and 10,000K.

Figure 4:
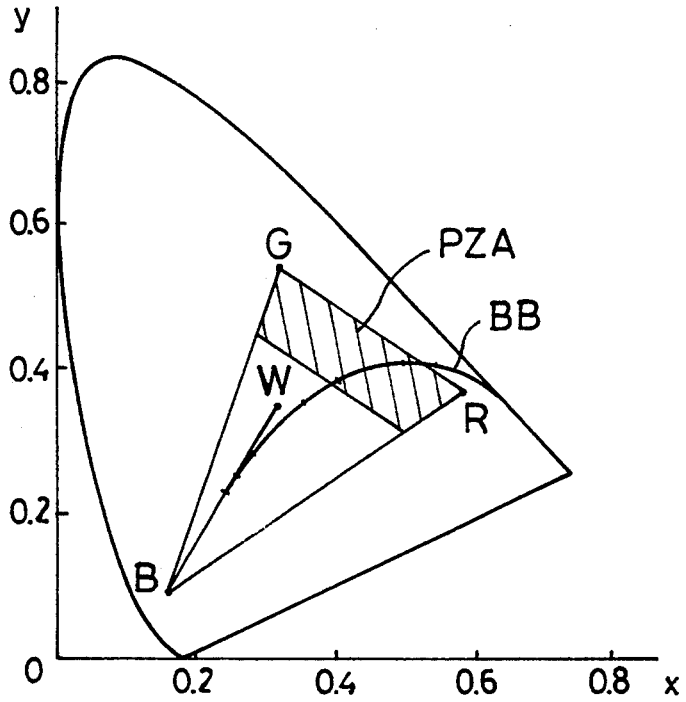
FIG. 4 is a chromaticity diagram for explaining an imaginary setting operation of the temporary light source in the embodiment shown in FIG. 1.
Figure 5:
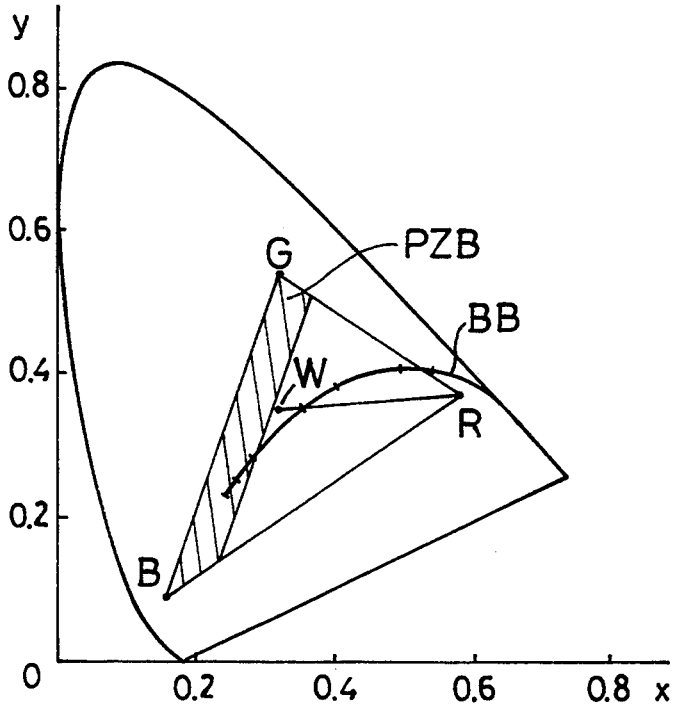
FIG. 5 is a chromaticity diagram for explaining another working aspect of the imaginary setting operation.

Further, it is optimum that, in an event where the locus of luminous flux of the desired mixed color light is positioned within such hatched zone PZA as shown in the chromaticity triangle of FIG. 4, the temporary light source B' is imaginarily set on a line component BW to obtain the mixing ratio, whereas, in an event when the locus of luminous flux of the desired mixed color light is positioned in such hatched zone PZB as shown in FIG. 5, the temporary light source R' is imaginarily set on a line component RW to obtain the mixing ratio. That is, the mixing ratio is to be obtained by imaginarily setting the temporary light source in an event where the emission colors of the white series light source W and of one of the red, green and blue series light sources R, G and B which is at an apex opposing one side of the triangle on the respective chromaticity diagrams.

Figure 6:
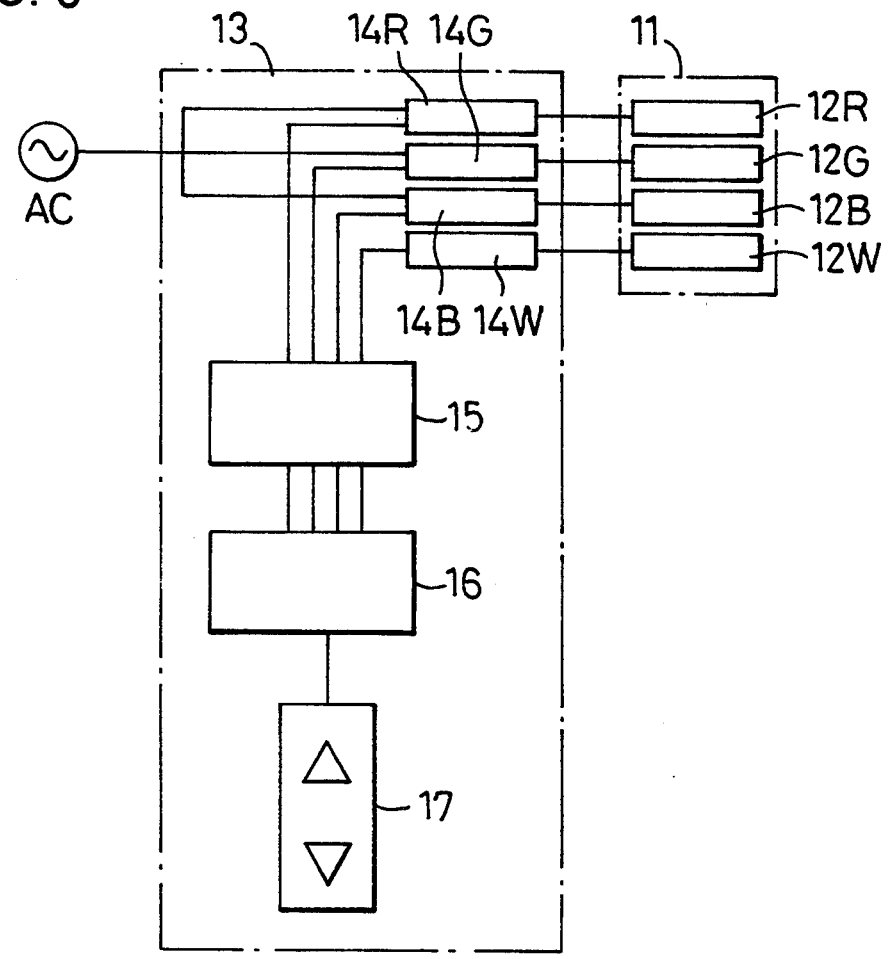
FIG. 6 shows in a block circuit diagram an embodiment of the variable color luminaire according to the present invention.

In realizing in practice the variable color lighting with the calculation results of the mixing ratio in the foregoing arrangement, such device as shown in FIG. 6 is employed. In this case, a lamp section 11 includes four lamps or discharge lamps 12R, 12G, 12B and 12W as the light sources, which are lighted as controlled by a control means 13 including lighting circuits 14R, 14G, 14B and 14W respectively connected directly to each of the lamps and operated through a dimming signal generating circuit 15, memory circuit 16 and color adjust switch 17.

The memory circuit 16 stores the data of the operation results described with reference to the foregoing color mixing method, with respect to every emission color of the respective lamps. In this case, the color mixing in accordance with the foregoing color mixing method with the color temperature varied can be executed, so as to attain the desired mixed color. The memory circuit 16 needs not be limited to be of the arrangement which stores the data obtained by means of ROM or the like, but an arrangement in which the mixing ratio is operated for every operation by means of a microprocessor or the like may also be employed. According to the latter arrangement, the operation process can be simplified, operation speed can be also shortened, and required program size can be minimized.

According to another feature of the present invention, it is made possible to attain a sufficient quantity of light with a simpler arrangement, to assure a stable lighting with any flickering effectively prevented even when, in particular, the dimming level is very close to the minimum level, and thus to realize the variable color lighting. In this case, in particular, it is discriminated whether the dimming level of any one of the first to third lamps as well as another fourth lamps is present or not in stable lighting zone so that, when the lamps involve one or ones the dimming level of which is not in the stable lighting zone, the dimming level of such lamp or lamps is varied to the stable lighting zone, while the dimming level of other lamps or lamp in the stable lighting zone is so modified as to restrain any change in the emission color, as a useful measure.

Figure 8:
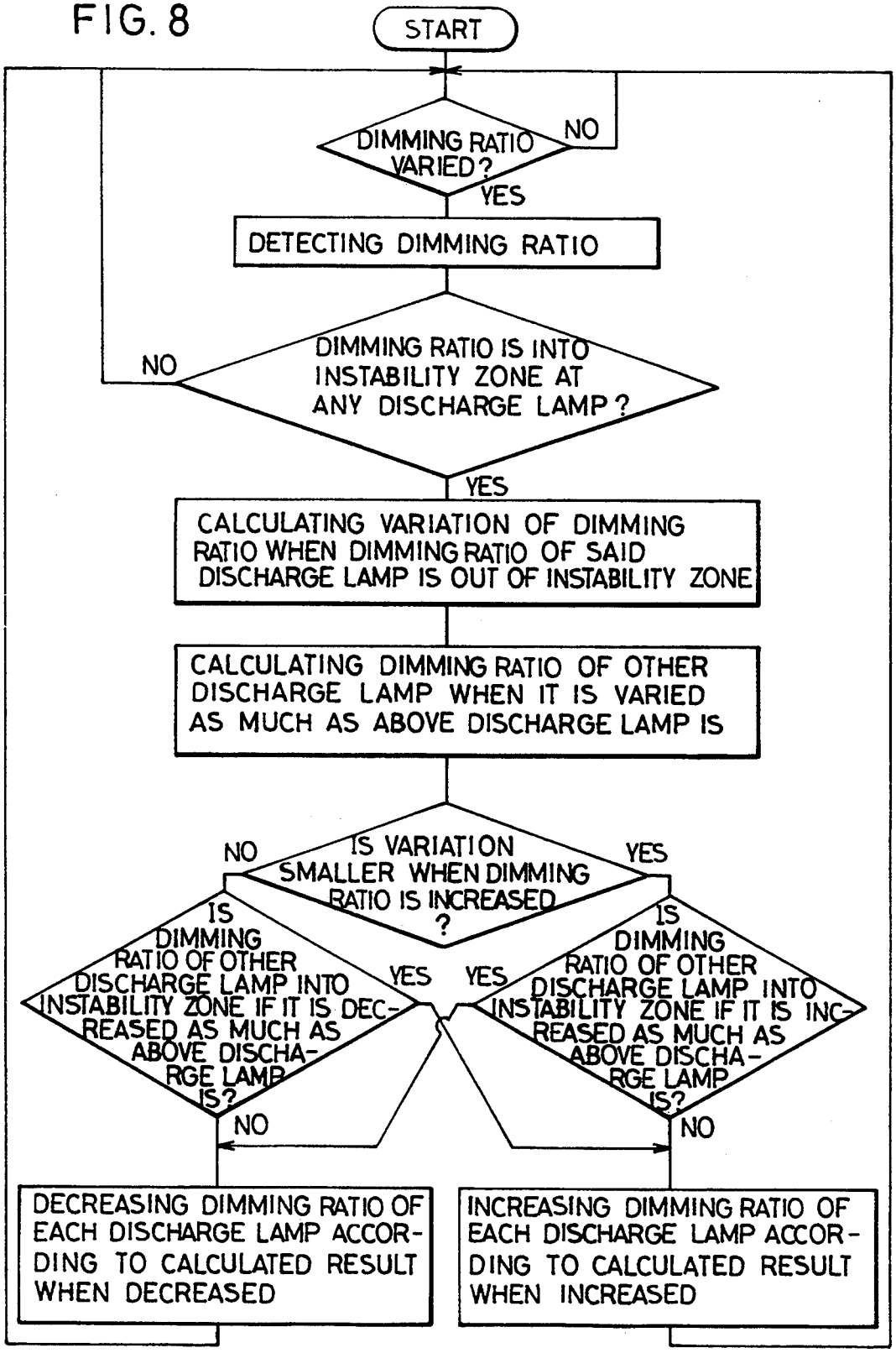
FIG. 8 shows in a flow chart details of operation in another working aspect of the variable color luminaire according to the method of the present invention shown in FIG. 1.

Referring more specifically to the above with reference to FIG. 8, a working aspect for realizing the above feature incorporates in, for example, the dimming signal generating circuit 15 as shown in FIG. 6, means for discriminating whether or not the dimming level of the lamps 12R, 12G, 12B and 12W is in the stable lighting zone, means for varying the dimming level of any one or ones of the lamps which is not in the stable lighting zone to the stable lighting zone, and means for modifying the dimming level of other lamps or lamp in the stable lighting zone so as to restrain any change in the emission color of said other lamps or lamp.

Now, in lighting the lamps in dimmed state, it becomes difficult to maintain their stable lighting as the degree of dimming is lowered, that is, as their optical output decreases, and the flickering takes place. Further, in the state where the degree of dimming is low, there is a tendency that the lamp voltage rises, as shown graphically in FIG. 7, from a state shown by a broken line curve to another state of a solid line curve, and this phenomenon of the lamp voltage rising under the small dimming degree becomes remarkable particularly under low temperature conditions and when the lamp tube diameter is small. In this event, the operating point becomes unstable due to the relationship between output characteristics of the lighting circuit and lamp characteristics, and there may occur a so-called jump phenomenon in which the optical output fluctuates between a plurality of states. Such jump phenomenon is apt to occur in a range of the dimming degree from 10 to 20%.

Here, this working aspect is useful in maintaining the lamps 12R, 12G, 12B and 12W in the state of the stable lighting at a jump phenomenon takes place in practice, that is, in a zone of 10 to 20% lighting. Thus, when the dimming level of any of the lamps 12R, 12G, 12B and 12W is in the unstable lighting zone, the dimming level of such lamps is shifted from the unstable lighting zone to the stable lighting zone, and, in accordance with the extent of such shift from the unstable lighting zone to the stable lighting zone, the dimming level of the other lamps in the stable lighting zone is modified substantially to the same extent. When, for example, the chromaticity coordinates of the emission colors of the light source lamps 12R, 12G, 12B and 12W are as in a following TABLE III, the dimming level (in %) for obtaining the color temperatures 3,000K, 5,000K and 10,000K are as shown in a following TABLE IV:

TABLE III

| Light Source | Chromaticity x | Coordinates y | Luminous Flux (1 m) |
|---|---|---|---|
| R | 0.5650 | 0.3300 | 2,100 |
| G | 0.3270 | 0.5240 | 3,300 |
| B | 0.1540 | 0.0850 | 840 |
| W | 0.3730 | 0.3760 | 2,900 |

TABLE IV

| Color Temp. (K) | R | G | B | W | Max. Flux |
|---|---|---|---|---|---|
| 3,000 | 100 | 63 | 4 | 78 | 6,600 |
| 5,000 | 60 | 100 | 56 | 79 | 7,800 |
| 10,000 | 12 | 75 | 100 | 93 | 6,300 |

Figure 7:
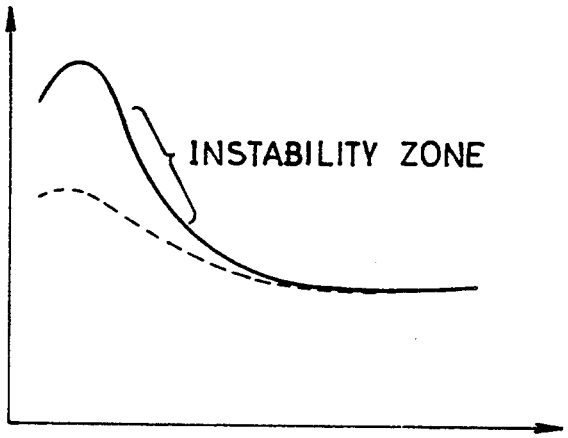
FIG. 7 is a diagram for graphically explaining stability and instability operation in the embodiment of FIG. 6.

As will be clear from the above TABLE IV, the presence of the dimming level of the lamp 12R in the unstable lighting zone in an event when the color temperature of 10,000K is to be obtained, causes a varying width of the lamp voltage V1*a* to become high with respect to the lamp current I1*a* due to the foregoing jump phenomenon as shown in FIG. 7, for example, and the lighting is made unstable. Now, in accordance with a flow chart shown in FIG. 8, the dimming level of the lamp 12R is lowered to 10% at which the lighting can be prevented from being shifted to the unstable zone, and the dimming level of other lamps 12G, 12B and 12W is also lowered at the same ratio, so that the dimming level of the lamps 12R, 12G, 12B and 12W will be 10%, 63%, 83% and 77%, respectively.

Figure 9:
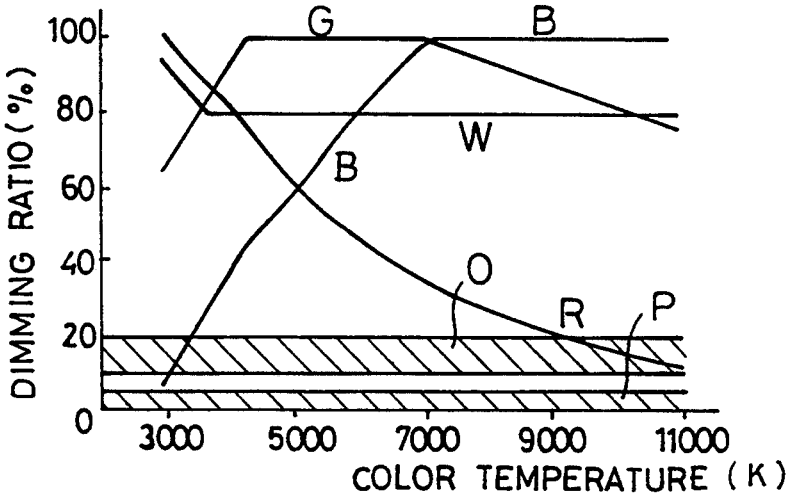
FIG. 9 is a diagram showing the relationship between the emission color temperature and the dimming level of the light sources for the variable color lighting in the working aspect shown in FIG. 8.
Figure 10:
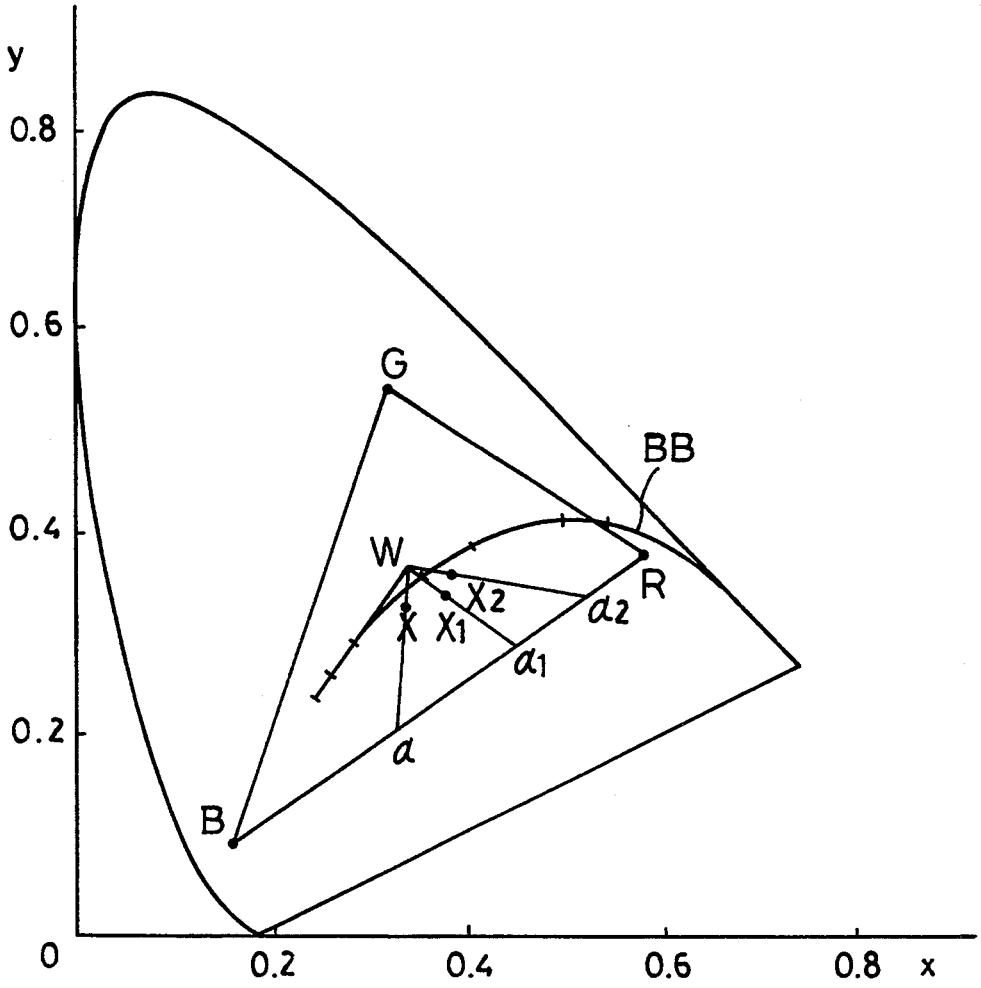
FIG. 10 is a chromaticity diagram showing the basic idea of the present invention.

Further, the emission colors are made sequentially variable in a range of the color temperature from 3,000 to 11,000K, and the dimming level of the lamps 12R, 12G, 12B and 12W will be as shown in FIG. 9, in which the dimming level of the lamp 12B falls in the unstable lighting zone in a range from 3,200 to 3,400K, upon which the dimming level of the lamp 12B is lowered to 10% in a range of the color temperature from 3,200 to 3,280K and to 20% in a range from 3,280 to 3,400K. For the remaining lamps 12R, 12G and 12W, too, the dimming level is varied at the same ratio as that in the dimming level of the lamp 12B. In restraining as much as possible any change in the quantity of light of the entire lamp device 11, the dimming level of the lamp 12B is lowered to 10% in a color temperature range from 3,280 to 3,300K but is raised to 20% in the range from 3,300 to 3,320K, whereby it is made possible to prevent the lamp 12B from being unstably lighted without causing no substantial change in the emission color and quantity of light in the event where the lamp 12B is in the unstable lighting zone at a high color temperature. In FIG. 9, a hatched zone O denotes the zone in which the jump phenomenon is apt to take place, and another hatched zone P represents a control zone occurring upon the lowering of the dimming degree to render the stable lighting to be unable to maintain.

In the present invention, a variety of design modifications can be adopted. For example, the arrangement of the present invention described with reference to the embodiments applied to the luminaire in the foregoing may also be applied to such other objects as a variable color display system and so on. Further, while the aspects in which the light sources for the so-called primary color mixing are made three have been described, it is possible to employ four or more of the light sources. While the description has been made with reference to the three light sources of red, green and blue series, it is of course possible to employ other combination of colors. While in the above the aspect employing a single light source for the secondary color mixing has been described, two or more of the light sources may be employed for the same purpose, and the light source of the white series for the same purpose may even be of any other color. In addition, means for attaining the sufficient quantity of light and the stable lighting of the light sources has been described as incorporated in the dimming signal generating circuit in the aspect shown in FIG. 8, but the same may be provided in other part of the control means in the embodiment of FIG. 6.

What is claimed is:

1. A color mixing method for variable color lighting, wherein first to third light sources of mutually different emission colors are prepared, another light source of another emission color the chromaticity coordinates of which are disposed within a figure drawn on a chromaticity diagram by connecting respective chromaticity coordinates of emission colors of a plurality of light sources including said first to third light sources is prepared, a temporary light source is imaginarily set by mixing said emission color of one of said plurality of light sources including the first to third light sources with said another emission color of said another light source, a mixing ratio of the emission colors of at least two remaining light sources in said plurality of light sources including the first to third light sources and of said temporary light source is calculated, and a further mixing ratio of required emission colors of the respective light sources for obtaining a mixed color light which draws a desired locus on said chromaticity diagram is obtained on the basis of said mixing ratio calculated.

2. The method according to claim 1, wherein said plurality of light sources of different emission colors are three of first to third light sources of red, green and blue series.

3. The method according to claim 2, wherein said figure drawn on said chromaticity diagram by connecting respective said chromaticity coordinates of said first to third light sources is triangle, said chromaticity coordinates of said another emission color of said another light source being disposed within said triangle.

4. The method according to claim 1, wherein said another light source is a single light source of white series.

5. The method according to claim 3, wherein said temporary light source is imaginarily set by mixing said emission color of said another light source with said emission color of one of said first to third light sources the chromaticity coordinates of which color are at an apex of said triangle of the first to third light sources on said chromaticity diagram and opposing one side of the triangle to which said locus of said desired mixed color light is the closest as seen from a position of the chromaticity coordinates of the emission color of another light source.

6. The method according to claim 5, wherein said another light source is a single light source of white series.

7. A variable color luminaire, comprising first to third light sources of mutually different emission colors, another light source of another emission color the chromaticity coordinates of which are disposed within a figure drawn in a chromaticity diagram by connecting respective chromaticity coordinates of said emission colors of a plurality of light sources including said first to third light sources, means for imaginarily setting a temporary light source by mixing said emission color of one of said plurality of light sources including the first to third light sources with said another emission color of said another light source, means for calculating a mixing ratio of the emission colors of at least two remaining light sources in said plurality of light sources including the first to third light sources and of said temporary light source, and means for obtaining a further mixing ratio of required emission colors of the respective light sources for obtaining a mixed color light which draws a locus on said chromaticity diagram on the basis of said mixing ratio calculated.

8. The luminaire according to claim 7, wherein said plurality of light sources of different emission colors are three of first to third light sources of red, green and blue series.

9. The luminaire according to claim 7, wherein said figure drawn on said chromaticity diagram by connecting respective said chromaticity coordinates of said first to third light sources is triangle, said chromaticity coordinates of said another emission color of said another light source being disposed within said triangle.

10. The luminaire according to claim 7, wherein said another light source is a single light source of white series.

11. The luminaire according to claim 7, which further comprises means for discriminating whether or not a dimming level of respective said plurality of light sources including said first to third light sources and said another light source is in a stable lighting zone, and a dimming control means for varying said dimming level of any one of the light sources discriminated to be not in said stable lighting zone so as to be in said stably lighting zone and for modifying said dimming level of remaining light sources discriminated to be in the stable lighting zone so as to restrain any change in the emission color of the remaining light sources.

12. The luminaire according to claim 11, wherein said dimming control means includes means for raising said dimming level of said light source not in the stable lighting zone up to the stable lighting zone, and means for raising said dimming level of remaining light sources in the stable lighting zone in accordance with a rate of raising of said dimming level of the light source not in the stable lighting zone.

13. The luminaire according to claim 11, wherein said dimming level control means includes means for lowering said dimming level of said light source not in the stable lighting zone down to the stable lighting zone, and means for lowering said dimming level of remaining light sources in the stable lighting zone in accordance with a ratio of lowering of said dimming level of the light source not in the stable lighting zone.

14. The luminaire according to claim 11, wherein said dimming control means is provided for varying said dimming level of respective said light sources so that any change in the quantity of light of the light source will be closer to the minimum.

* * * * *